US007351092B2

(12) United States Patent
Tseng

(10) Patent No.: US 7,351,092 B2
(45) Date of Patent: Apr. 1, 2008

(54) CONNECTION ASSEMBLY FOR A LIGHT STRING HAVING A PRIMARY WIRE AND SECONDARY WIRES ELECTRICALLY CONNECTED TO THE PRIMARY WIRE AND EACH SECONDARY WIRE HAVING LIGHT BULBS THEREON

(76) Inventor: Wei-Jen Tseng, 5F, No. 10, Lane 23, Tungshan St., Hsinchu City (TW)

( * ) Notice: Subject to any disclaimer, the term of this patent is extended or adjusted under 35 U.S.C. 154(b) by 0 days.

(21) Appl. No.: 11/481,297

(22) Filed: Jul. 5, 2006

(65) Prior Publication Data

US 2008/0009165 A1 Jan. 10, 2008

(51) Int. Cl.
*H01R 11/20* (2006.01)

(52) U.S. Cl. ..... 439/418; 439/505

(58) Field of Classification Search ..... 439/402–405, 439/408, 413, 414, 418, 419, 502, 505
See application file for complete search history.

(56) References Cited

U.S. PATENT DOCUMENTS 4,778,405 A * 10/1988 Sterken ..... 439/395
5,964,613 A * 10/1999 Huang ..... 439/417
2005/0227529 A1* 10/2005 Mrakovich et al. ..... 439/402

* cited by examiner

*Primary Examiner*—Ross Gushi
(74) *Attorney, Agent, or Firm*—William E. Pelton, Esq.; Cooper & Dunham LLP

(57) ABSTRACT

A light string includes a primary electrical wire, secondary electrical wires each electrically connected to the primary electrical wire and having multiple light bulbs thereon and multiple connection assemblies. Each connection assembly is composed of a base to securely receive therein the primary electrical wire and a corresponding one of the secondary electrical wires, a cap mounted on top of the base to sandwich the primary electrical wire and the corresponding one of the secondary electrical wire with the base and two contacts sandwiched between the base and the cap to electrically connect the primary electrical wire to the corresponding one of the secondary electrical wires.

31 Claims, 23 Drawing Sheets

18/

CONNECTION ASSEMBLY FOR A LIGHT STRING HAVING A PRIMARY WIRE AND SECONDARY WIRES ELECTRICALLY CONNECTED TO THE PRIMARY WIRE AND EACH SECONDARY WIRE HAVING LIGHT BULBS THEREON

BACKGROUND OF THE INVENTION

1. Field of the Invention

The present invention relates to a connection assembly, and more particularly to a connection assembly for a light string having a primary wire and multiple secondary wires each electrically connected to the primary wire and having thereon multiple light bulbs such that the operator is able to arrange the light string in any pattern without worrying that the light string will be tangled during application.

2. Description of the Prior Art

When in seasonal festivals, light strings are probably the most popular choice for most of the people to enhance the festival atmosphere. For the diversified colors of the light bulbs and the resilient features of the electrical wires, the operator may use the light string to decorate any kind of objects, e.g. a tree, a contour of a house or even a car so that the entire street or neighborhood is full of festival joy. Therefore, the light string influence can be tremendous to people.

However, when employing the light string around an object, the operator often needs to use more than one set of light strings to adapt to different configurations and the electrical wire of each set of light strings may easily be tangled. To untangle the electrical wires sometimes takes a lot more time than to mount them on the object. Besides, when the issue comes to storage, the operator normally uses a box to store the light string for the next year. Still, the electrical wires storing in the box may be tangled as well. As a result, the operator needs to spend a lot of time finding out the solution to untangle the electrical wires, which is too time consuming and effort inefficient.

To overcome the shortcomings, the present invention tends to provide an improved connection assembly to mitigate the aforementioned problems.

SUMMARY OF THE INVENTION

The primary objective of the present invention is to provide an improved connection assembly to enable the operator to easily arrange the light string without worrying that the electrical wires may be tangled with one another whether it is during deployment or storage.

In order to accomplish the aforementioned objective, the connection assembly of the present invention includes a base, a cap, at least two contacts sandwiched between the base and the cap and optionally a positioning block sandwiched between the base and the cap to sandwich the at least two contacts. The base has at least one first groove defined to receive therein a first primary electrical wire and at least one second groove to receive therein a secondary electrical wire. Furthermore, the base has through holes evenly distributed through a top side face of the base and cutouts each defined in a bottom side face opposite to the top side face to communicate with a corresponding one of the through holes. The cap has positioning legs evenly distributed on a bottom face of the cap to correspond to and extend through the through holes so that a barb formed on a free end of each of the positioning legs is able to be received in a corresponding one of the cutouts to secure engagement between the base and the cap and the primary electrical wire and the secondary electrical wire are securely sandwiched between the base and the cap.

Furthermore, the at least two contacts are sandwiched between the base and the cap to respectively pierce through sheaths of the primary electrical wire and the secondary electrical wire such that the primary electrical wire and the secondary electrical wire are electrically connected to each other. Because the secondary electrical wire is provided with multiple bulbs, after the primary electrical wire is mounted around an object, the secondary electrical wires electrically connected to the primary electrical wire are readily mounted around the object without being tangled with the primary electrical wire.

Other objects, advantages and novel features of the invention will become more apparent from the following detailed description when taken in conjunction with the accompanying drawings.

DETAILED DESCRIPTION OF THE PREFERRED EMBODIMENT

Figure 1:
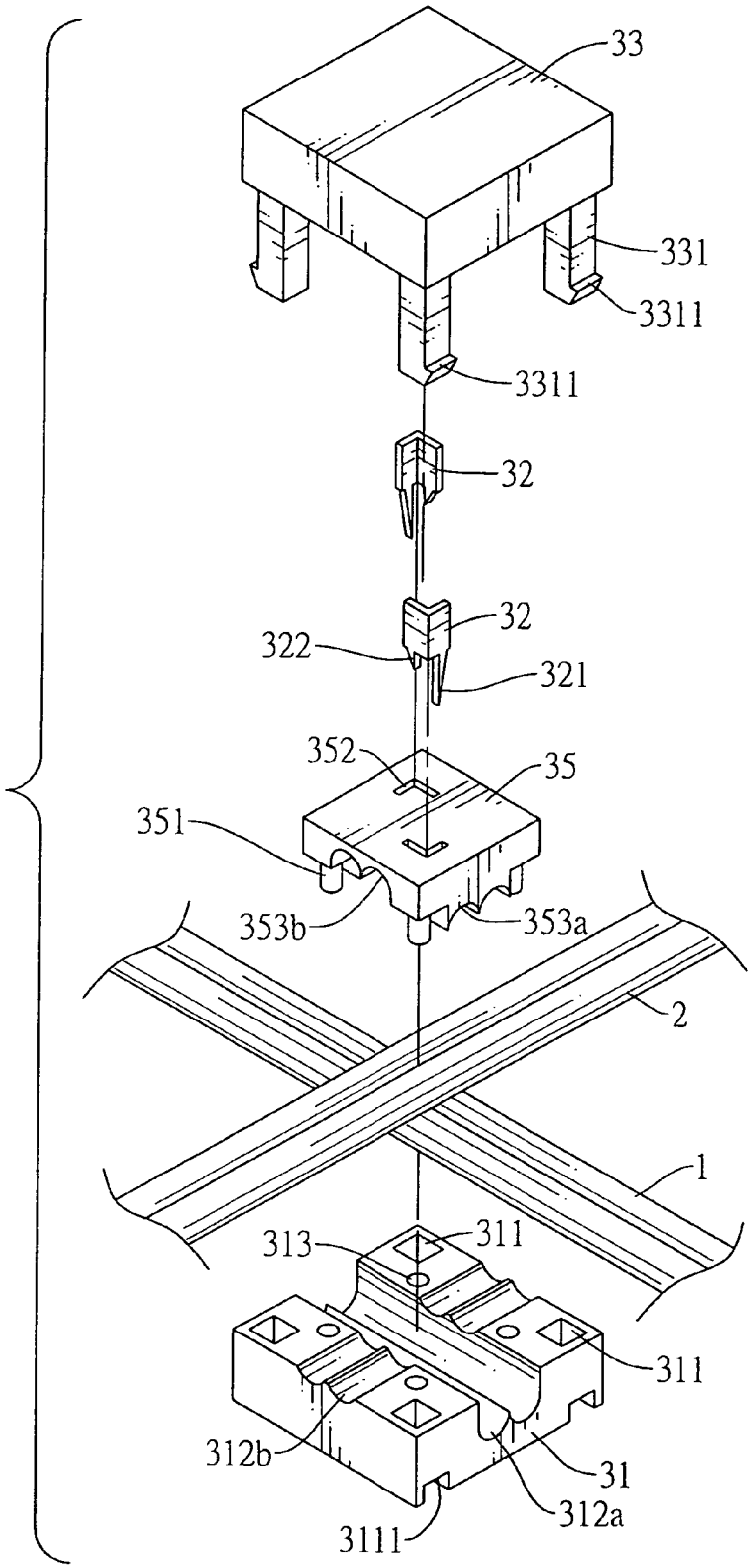
FIG. 1 is an exploded perspective view showing the elements of the connection assembly of the present invention.

With reference to FIG. 1, it is noted that a light string constructed in accordance with the present invention includes a primary electrical wire (1), a secondary electrical wire (2), a base (31), at least two (two are shown) contacts (32), a cap (33) and optionally a positioning block (35).

Figure 4:
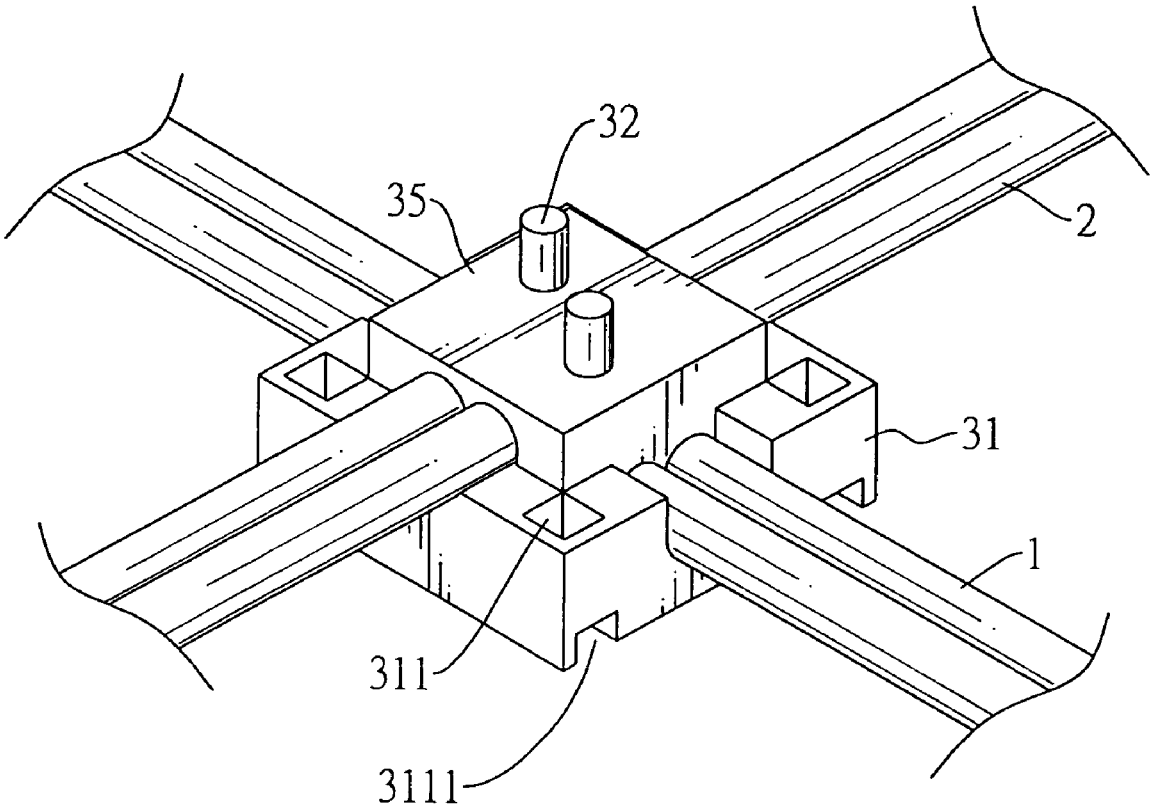
FIG. 4 is a perspective view showing another embodiment of the two contacts.

It is seen from FIG. 4 that the primary electrical wire (1) is provided with multiple second electrical wires (2) electrically connected to and distributed on both sides of the primary electrical wire (1). The connection assembly including the base (31), the two contacts (32), the cap (33) and the positioning block (35) is used to electrically connect the primary electrical wire (1) to the secondary electrical wire (2).

Figure 2:
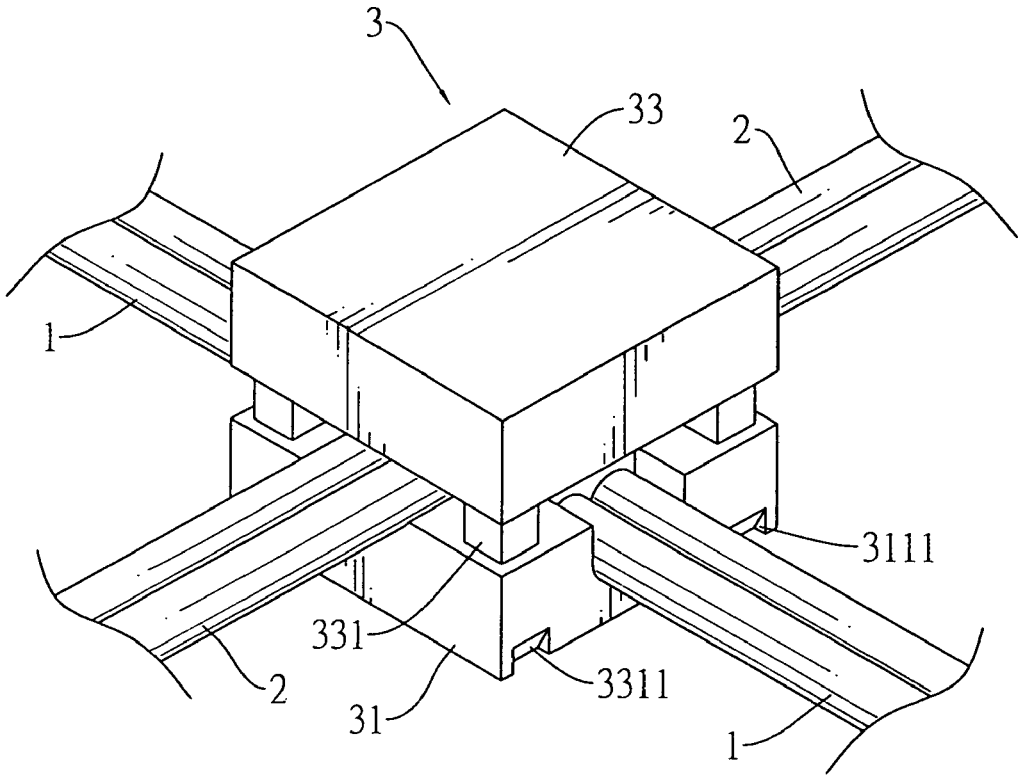
FIG. 2 is a perspective view showing that the elements in FIG. 1 are assembled.

Referring to FIG. 1 and with reference to FIG. 2, it is noted that the base (31) has multiple through holes (311) evenly defined in a top face of the base (31), multiple cutouts (3111) defined in a bottom face which is opposite to the top face to respectively communicate with a corresponding one of the through holes (311), two first grooves (312*a*) defined in the top face of the base (31) to receive therein the first electrical wires (1), two second grooves (312*b*) crossed with the two first grooves (312*a*) to receive therein the second electrical wire (2) and multiple positioning holes (313) defined in the top face of the base (31).

The cap (33) is provided with multiple positioning legs (331) extending downward from a bottom face of the cap (33) to be received in the through holes (311) and barbs (3311) respectively formed on free ends of each of the positioning legs (331) to be received in a corresponding one of the cutouts (3111) of the base (31).

The positioning block (35) has multiple positioning rods (351) extending downward from a bottom face of the positioning block (35) to be received in the positioning holes (313) of the base (31), extension holes (352) defined through the positioning block (35) to correspond to and receive therein the two contacts (32), multiple first positioning grooves (353*a*) defined in a bottom face thereof to correspond to the first grooves (312*a*) to position the primary electrical wire (1) after the primary electrical wire (1) is received in the first groove (312*a*) and multiple second positioning grooves (353*b*) defined in the bottom face thereof to correspond to the second grooves (312*b*) to position the secondary electrical wire (2) after the secondary electrical wire (2) is received in the secondary groove (312*b*). In this embodiment, it is noted that the extension hole (352) is configured to have a cross section substantially the same as that of the contact (32). Preferably, the cross section of both the extension hole (352) and the contact (32) is L shaped. Furthermore, each of the contacts (32) is provided with a sharpened first leg (321) to pierce through sheath (not numbered) of both the primary electrical wire (1) and the secondary electrical wire (2) and a sharpened second leg (322) to pierce through sheath (not numbered) of the secondary electrical wire (2) so that the primary electrical wire (1) is electrically connected to the secondary electrical wire (2).

When the connection assembly of the present invention is assembled, the primary electrical wire (1) and the secondary electrical wire (2) are respectively received in the first grooves (312*a*) and the second grooves (312*b*). With the positioning rods (351) of the positioning block (35) inserted into the corresponding positioning holes (313) of the base (31), the primary electrical wire (1) and the secondary electrical wire (2) are securely positioned between the base (31) and the positioning block (35).

Then the two contacts (32) are inserted into the extension holes (352) in the positioning block (35) to electrically connect the primary electrical wire (1) to the secondary electrical wire (2). Eventually, the positioning legs (331) of the cap (33) are extended into the through holes (311) of the base (31) to allow the barbs (3311) to be securely received in the corresponding cutouts (3111) to firmly sandwich the positioning block (35) with the base (31).

Figure 3:
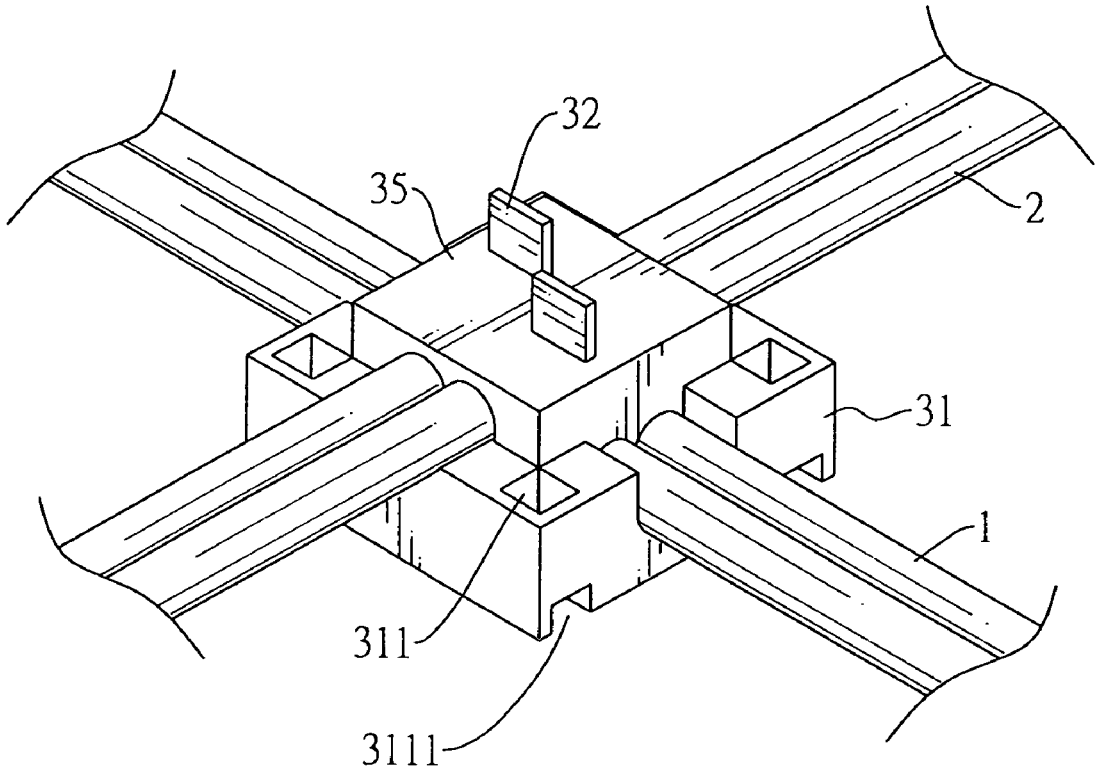
FIG. 3 is a perspective view showing that the at least two contacts are linearly formed.

With reference to FIG. 3, it is to be noted that the contacts (32) may have a linear cross section and can still accomplish the desired goal. With reference to FIG. 4, it is noted that each of the contacts (32) is cylindrically configured.

Figure 5:
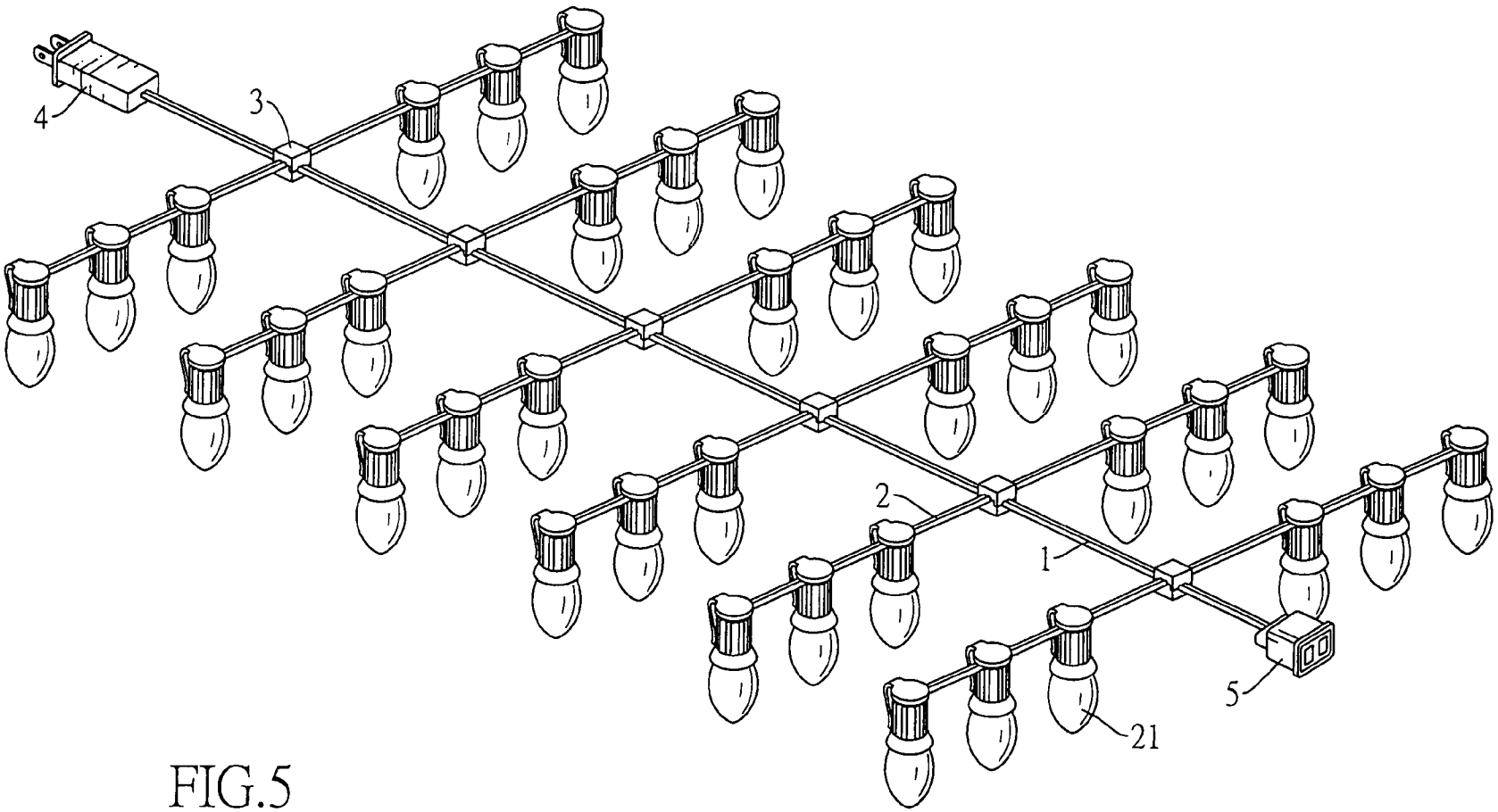
FIG. 5 is a schematic view showing the arrangement of a light string using the connection assembly of the present invention.
Figure 6:
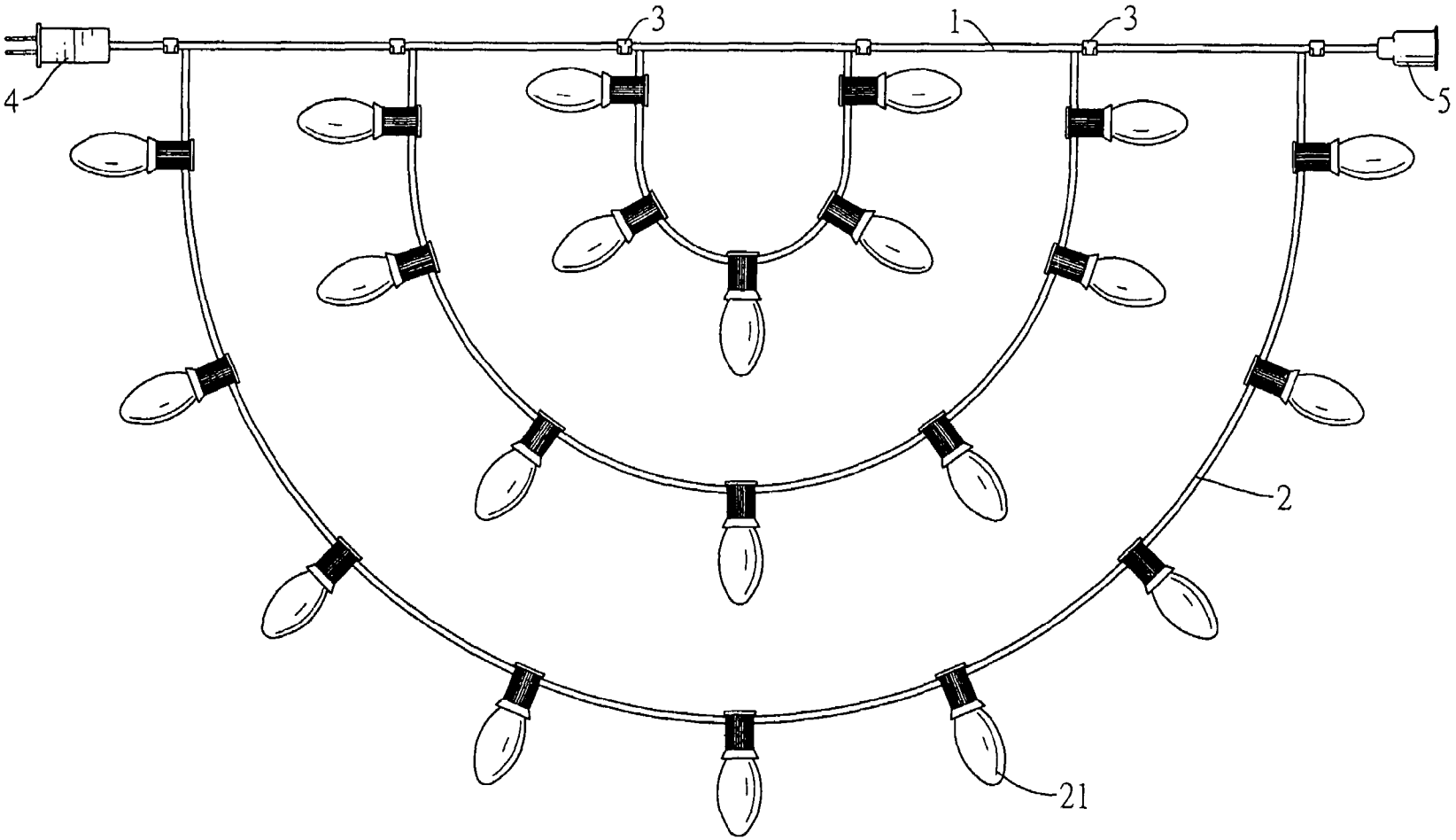
FIG. 6 is a schematic view showing the arrangement of the second embodiment of the present invention.
Figure 7:
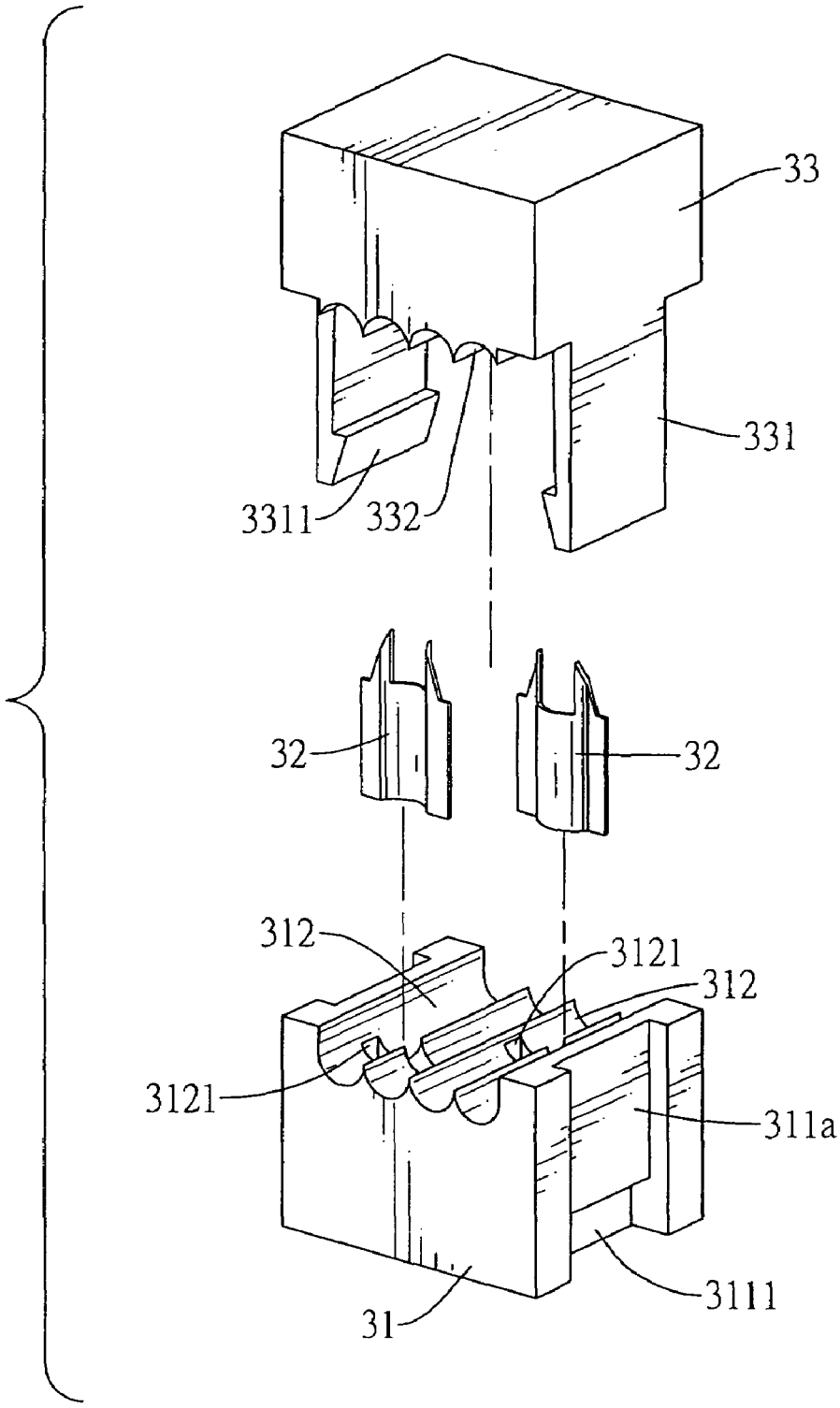
FIG. 7 is an exploded perspective view showing the elements of the present invention.
Figure 8:
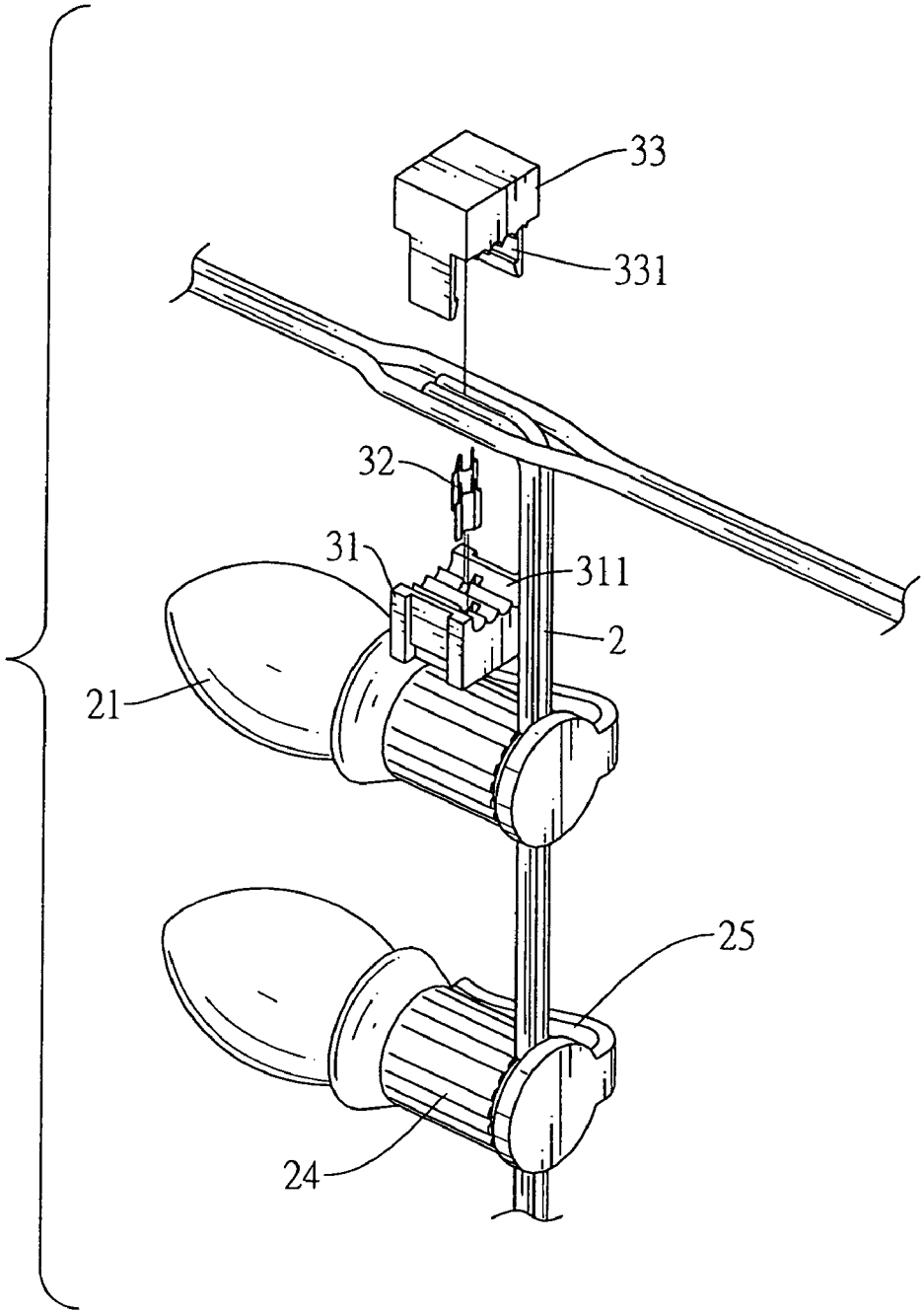
FIG. 8 is an exploded perspective view showing that the connection assembly of the present invention is employed with a primary wire and a secondary wire.
Figure 9:
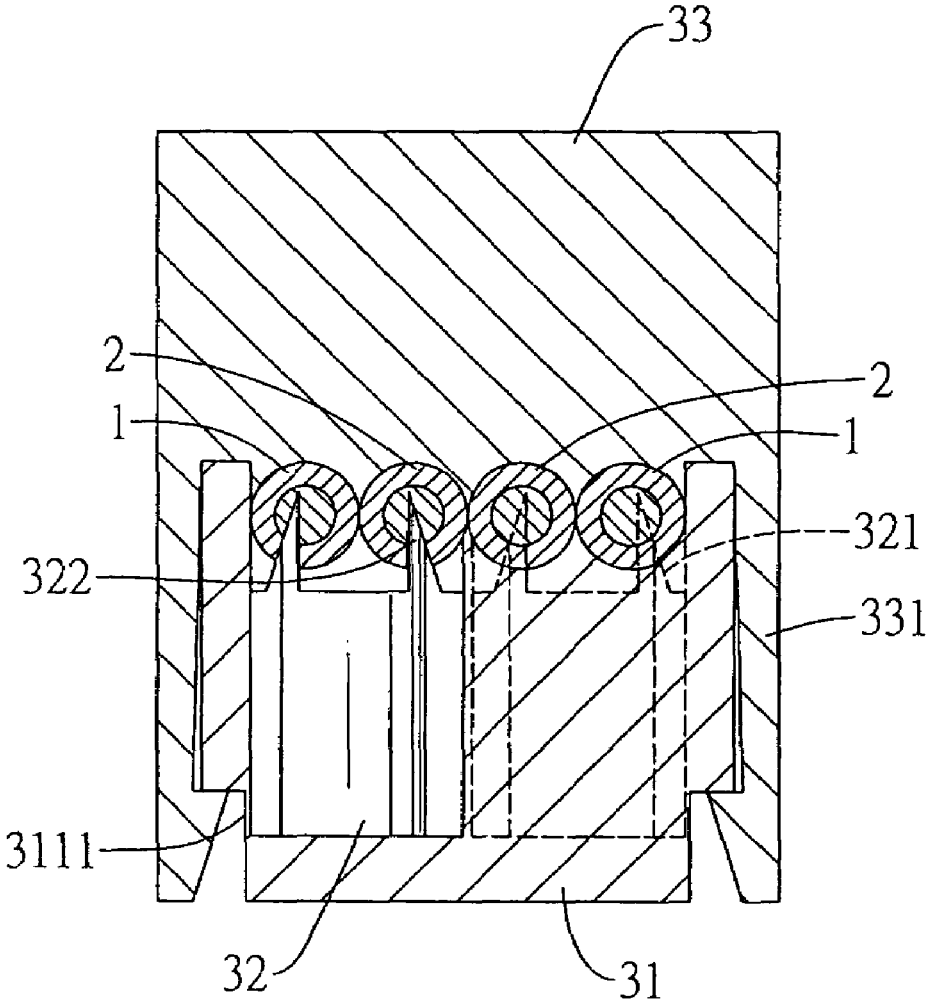
FIG. 9 a cross sectional view showing the internal structure after the connection assembly of the present invention is assembled.
Figure 10:
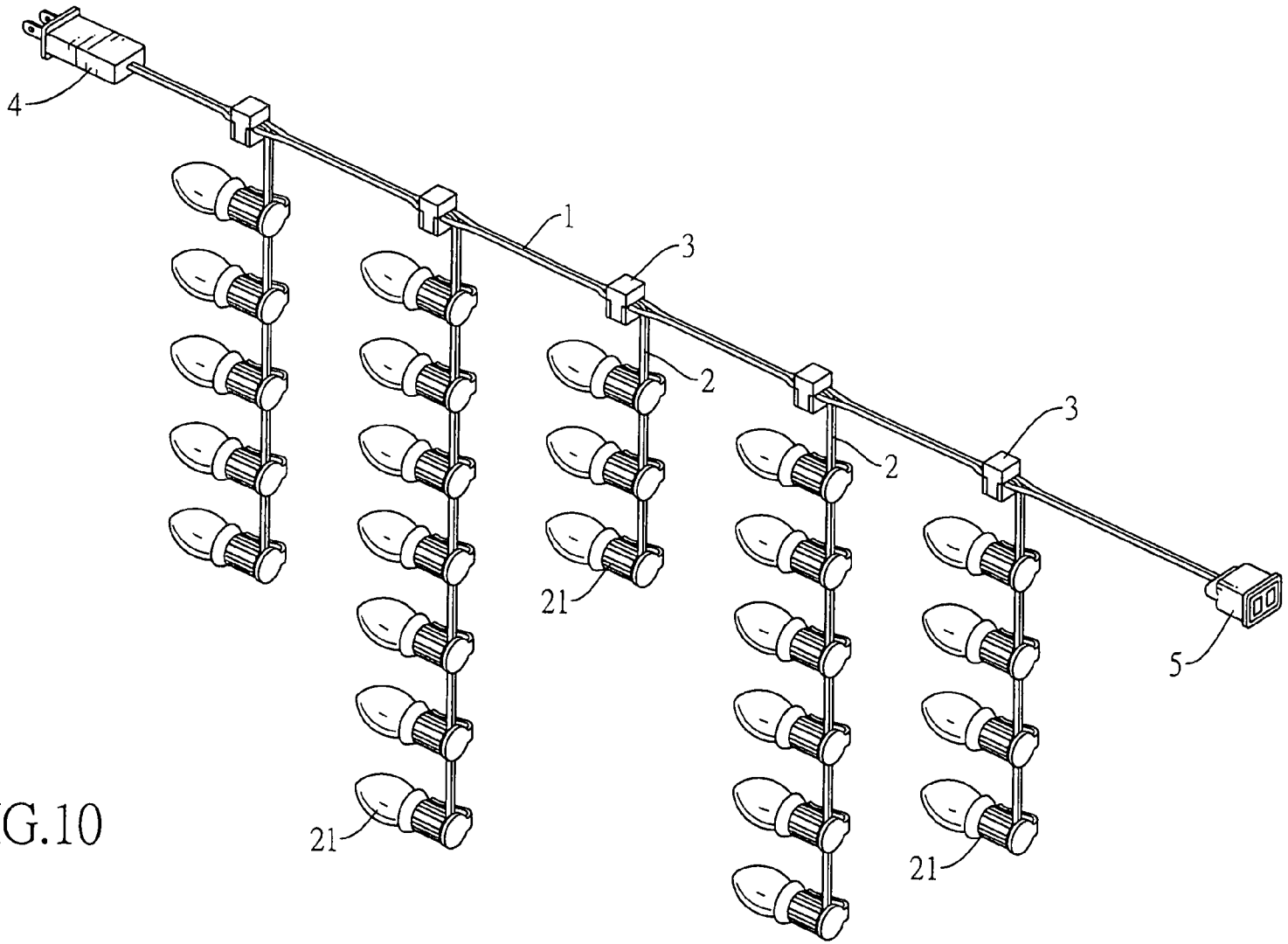
FIG. 10 is a perspective view showing the arrangement using the second embodiment of the connection assembly of the present invention.
Figure 11:
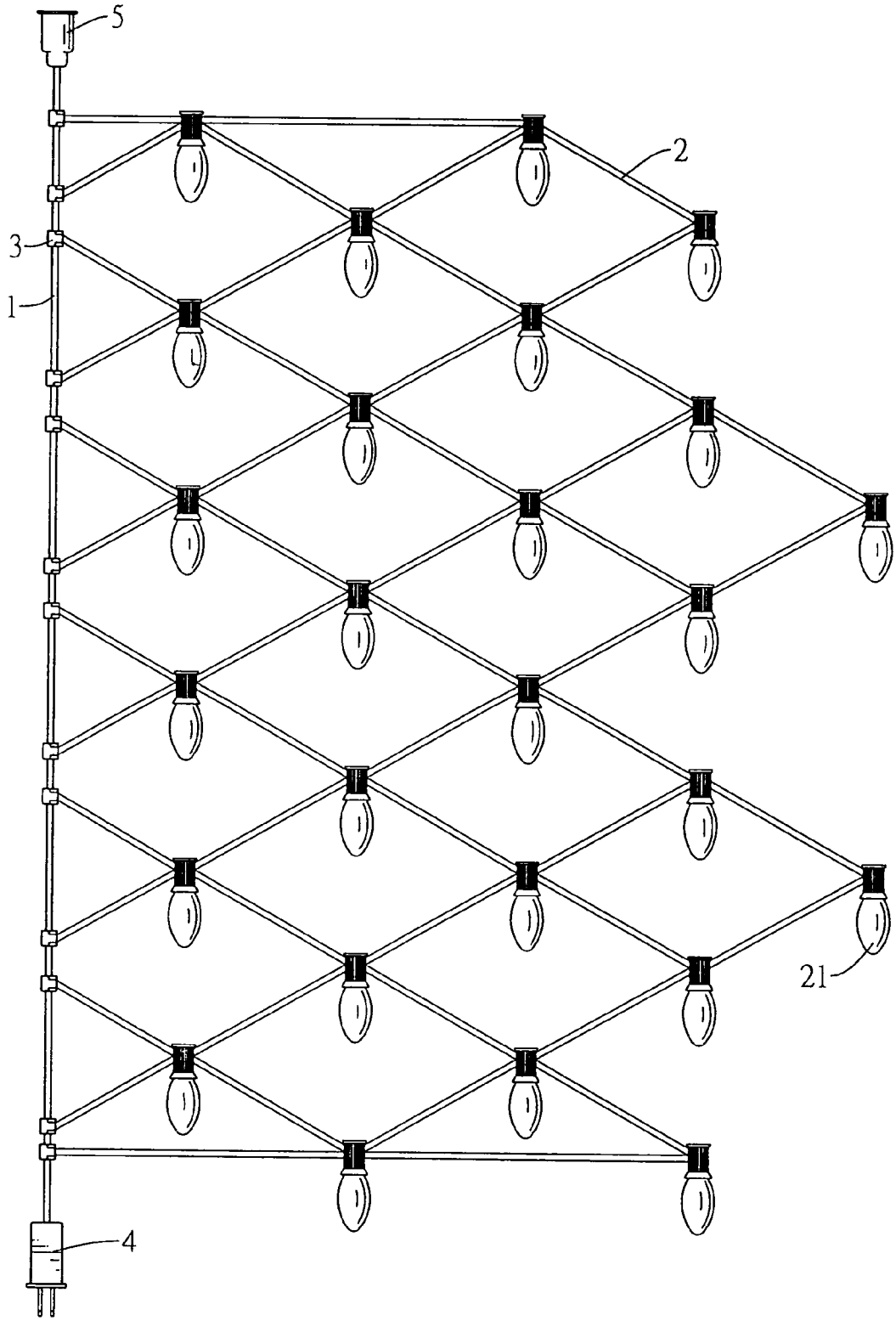
FIG. 11 is a side plan view showing that the clamp on each of the light bulb is used to clamp an additional secondary wire to as to weave a web.
Figure 12:
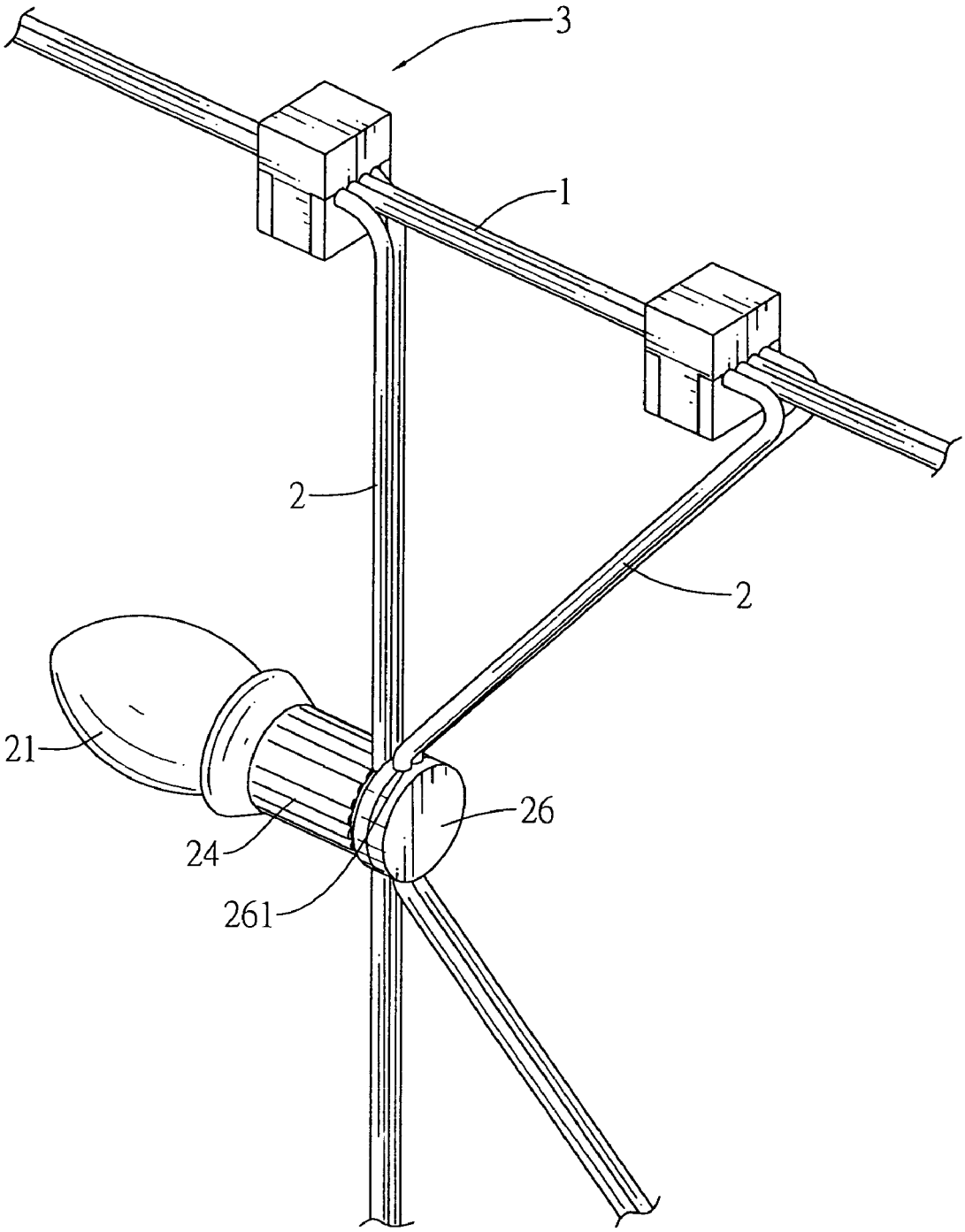
FIG. 12 is a perspective view showing that each light bulb is further composed of a securing element to secure an additional secondary wire.

With reference to FIG. 5, it is noted that due to the primary electrical wire (1) is cross to the secondary electrical wire (2) and the primary electrical wire (1) has multiple secondary electrical wires (2) provided on both sides of the primary electrical wire (1), the operator is able to easily arrange the light string of the present invention. In addition, in case the length of the light string of the present invention is not enough, with a socket (5) provided on one free end of the primary electrical wire (1) and a plug (4) provided on the other free end of the primary electrical wire (1), the operator is able to extend the length of the light string by inserting the plug (4) of another light string into the socket (5) of the light string.

With reference to FIGS. 8 to 12, it is noted that the secondary electrical wires (2) are provided to only one side of the primary electrical wire (1) and on the primary electrical wire (1) where the connection assembly (3) is mounted, the primary electrical wire (1) is split to receive therein the secondary electrical wire (2). To accomplish the aforementioned objective, the base (31) is not provided with first grooves (312) and second grooves (312) in parallel with the first grooves (312). That is, the first grooves (312) and the second grooves (312) are formed side by side with each other. Furthermore, two trenches (3121) are respectively defined in the first grooves (312) and the second grooves (312) to correspond to the two contacts (32). The through hole (311) in the first embodiment is now changed to a recessed area (311*a*) defined in opposite sides of the base (31) to correspond to two positioning legs (331) of the cap (33) and the cutout (3111) is defined in the opposite sides of a bottom face of the base (31) to communicate with a corresponding one of the recessed areas (311*a*) to correspond to one barb (3311) formed on a free end of each of the positioning leg (331). Therefore, it is noted that when the connection assembly (3) of the present invention is assembled, the two contacts (32) are inserted into the corresponding trenches (3121). Then the primary electrical wire (1) and the secondary electrical wire (2) are arranged in parallel with each other and received in the first grooves (312) and the second grooves (312) respectively. Due to the provision of the sharpened first leg (321) and the sharpened second leg (322) of each of the two contacts (32), the sheath of both the primary electrical wire (1) and the secondary electrical wire (2) are pierced and an electrical connection between the primary electrical wire (1) and the secondary electrical wire (2) is accomplished. Lastly, the cap (33) is applied to have the positioning legs (331) received in the corresponding recessed areas (311*a*) and the barbs (3311) received in the corresponding cutouts (3111) to securely sandwich the primary electrical wire (1) and the secondary electrical wire (2) with the base (31). Especially, it is noted that the sharpened first leg (321) has a length substantially the same as that of the sharpened second leg (322) of the contact (32) in that the primary electrical wire (1) is arranged in parallel with the secondary electrical wire (2). In addition, the bulbs (21) arranged on the secondary electrical wire (2) are respectively provided with one clamp (25) securely provided on a side of a corresponding one of the bulbs (21) to enable the bulb (21) to secure one of the secondary electrical wires (2) extending out from the primary electrical wire (1). Then a web is formed by the arrangement of the second embodiment. Still further, the clamp (25) on a side of the bulb (21) may also be a securing element (26) formed on a body (24) of the bulb (21) and having a hole (261) defined therethrough to allow extension of the secondary electrical wire (2).

Figure 13:
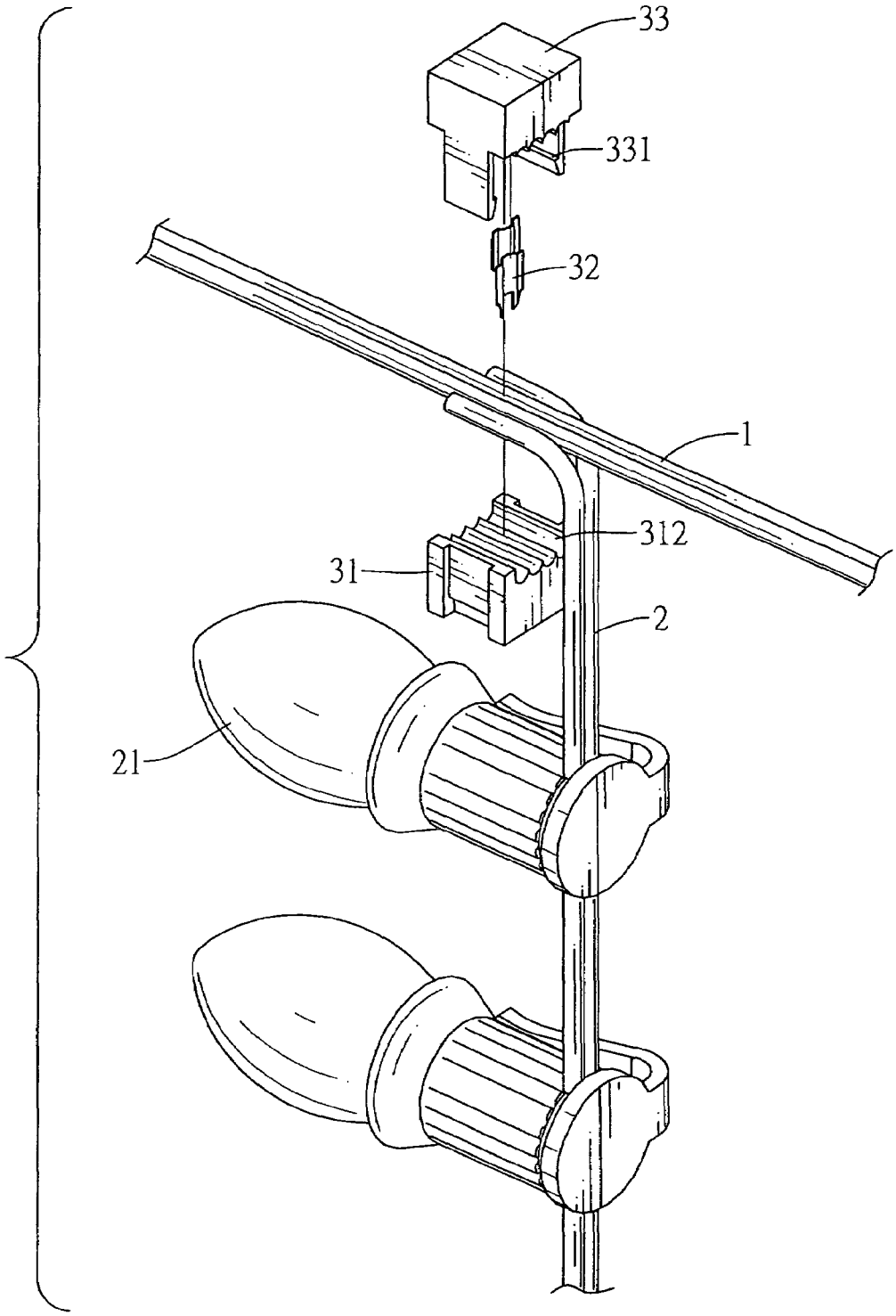
FIG. 13 is a perspective view showing that the distal end of the secondary wire is separated into halves and parallel to and outside the primary wire.
Figure 14:
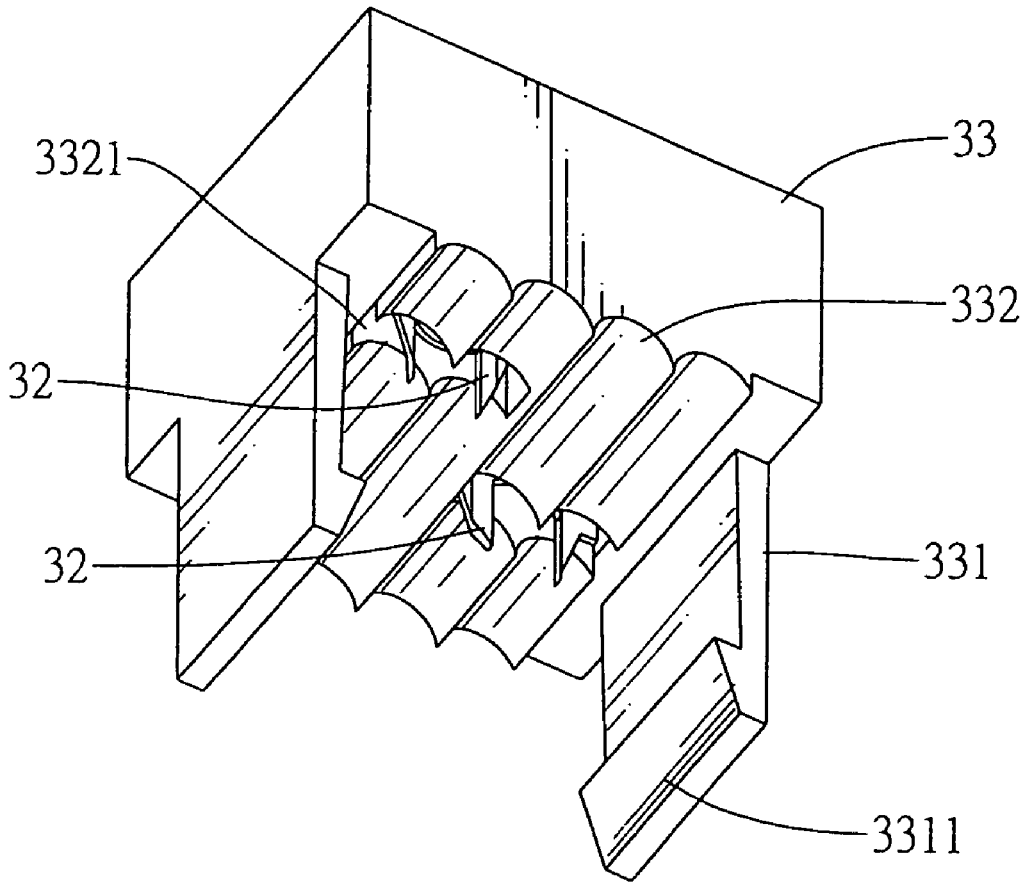
FIG. 14 is a perspective view showing that the two contacts are inserted into the cap.
Figure 15:
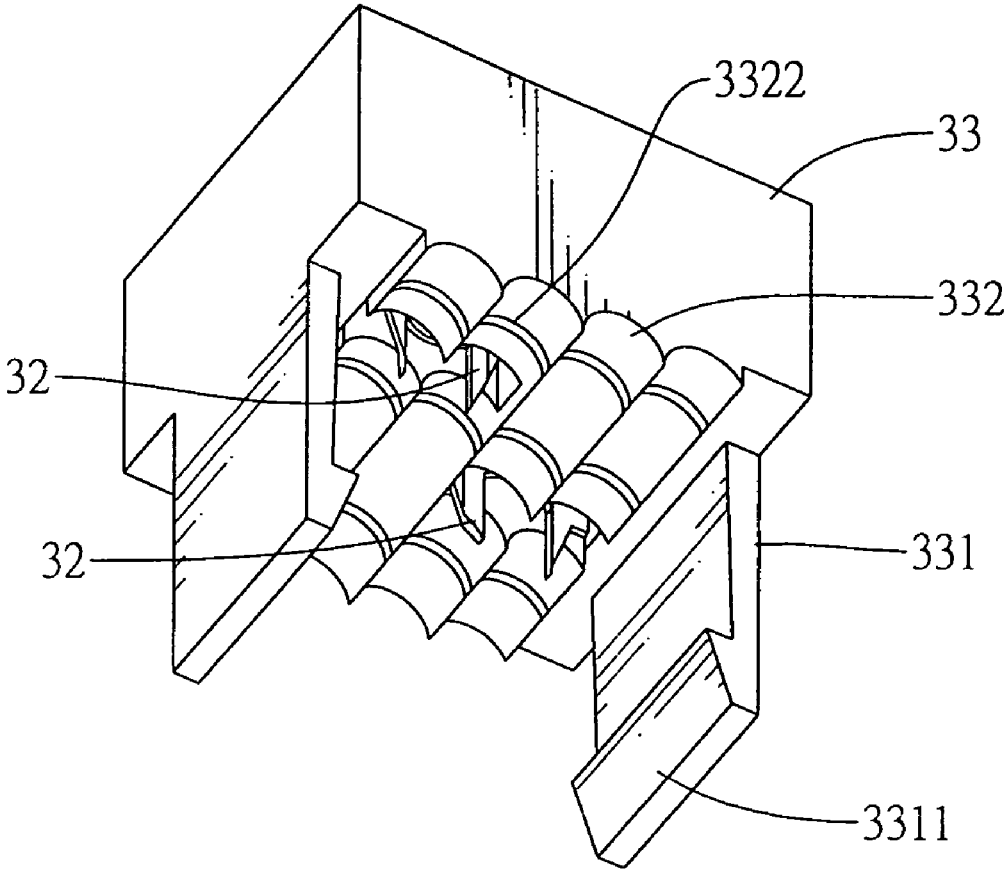
FIG. 15 is a perspective view showing that the cap has grooves defined in a bottom of the cap to position the primary wire and the secondary wires.

With reference to FIGS. 13, 14 and 15, it is noted that the first grooves (312) and the second grooves (312) still are arranged in parallel with one another to respectively receive therein the primary electrical wire (1) and the secondary electrical wire (2). However, a free end of the secondary electrical wire (2) is split into halves and the primary electrical wire (1) is sandwiched between the two halves of the free end of the secondary electrical wire (2). The cap (33) is now provided with pressing grooves (332) defined in a bottom face of the cap (33) to correspond to the first grooves (312) and the second grooves (312) in the base (31) and receiving slots (3321) respectively defined in the first grooves (312) and the second grooves (312) to receive therein the two contacts (32). Again, the sharpened first leg (321) and the sharpened second leg (322) share the same length in that the primary electrical wire (1) and the secondary electrical wire (2) are arranged in parallel with respect to one another. In order to increase friction to the primary electrical wire and the secondary electrical wire (2) after the cap (33) is mounted on top of the base (31), the cap (33) has grooves (3322) respectively defined in the pressing grooves (332). In this embodiment, there are three grooves (3322) defined in each of the first and second grooves (312). However, it is well known in the art that the more the grooves (3322) are in the first and second grooves (312), the more friction will be provided to the primary electrical wire (1) and the secondary electrical wire (2).

Figure 16:
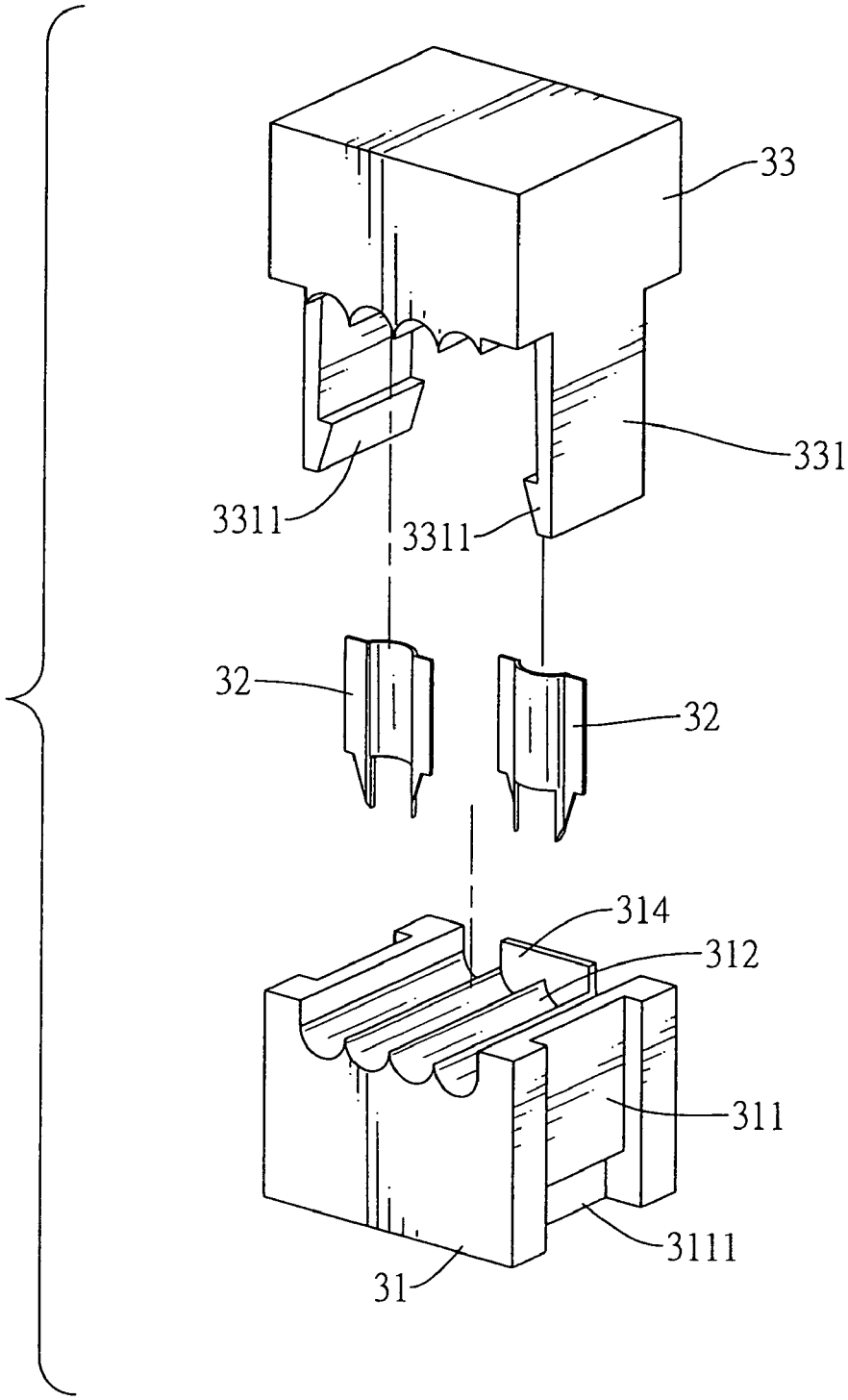
FIG. 16 is an exploded perspective view of the third embodiment of the present invention.
Figure 17:
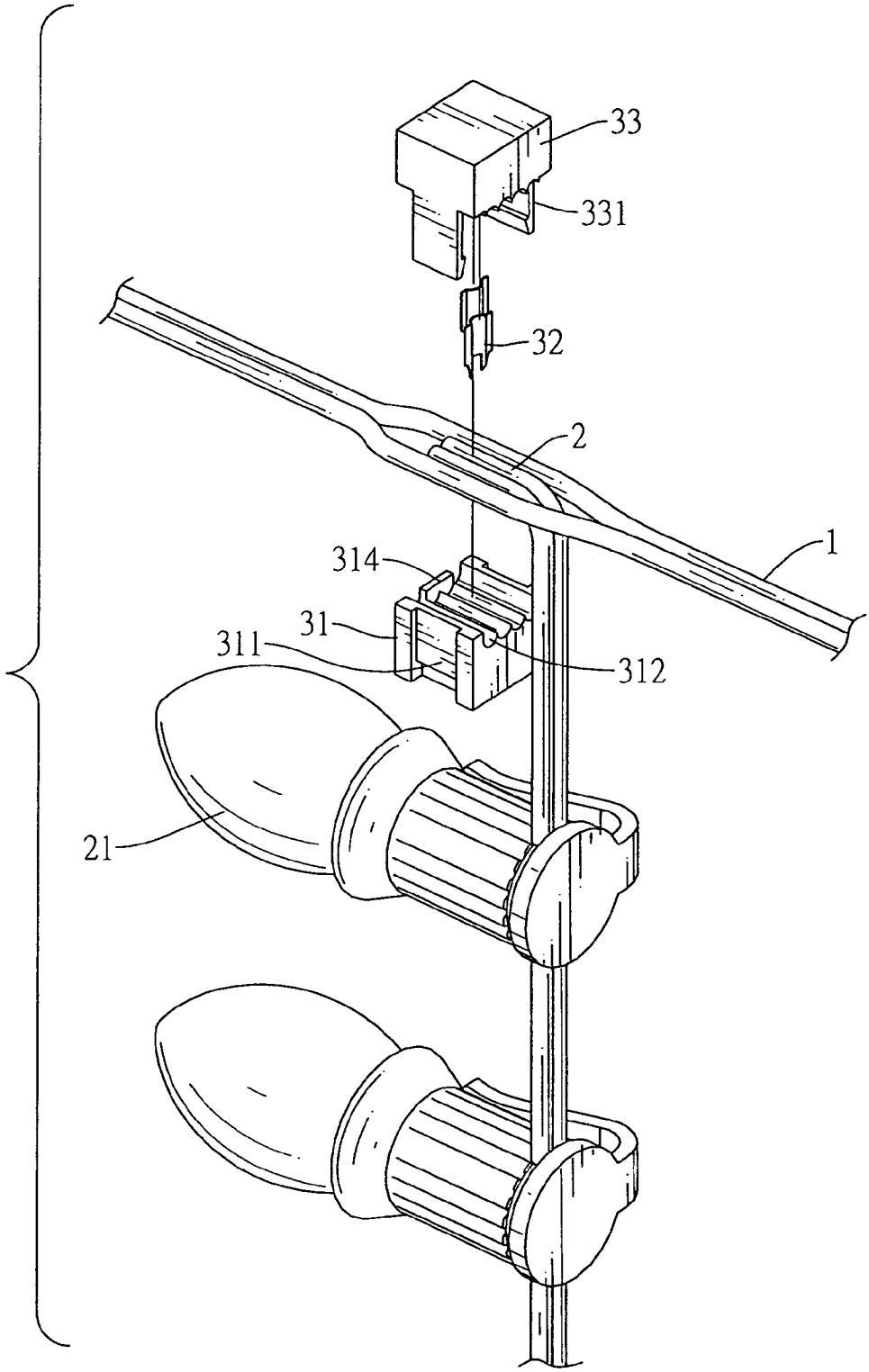
FIG. 17 is a perspective view showing that the secondary wires are sandwiched between the primary wire.
Figure 18:
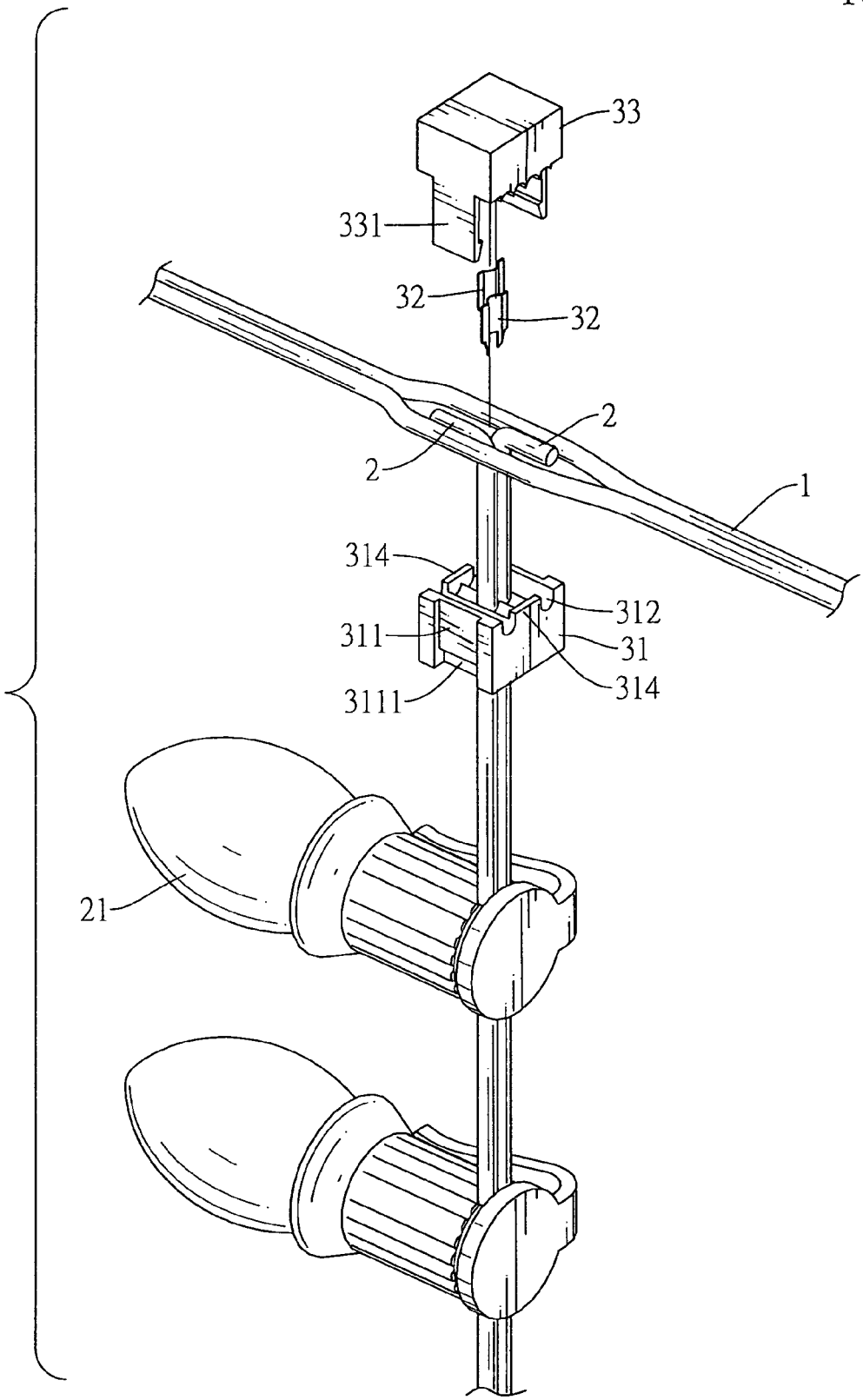
FIG. 18 is a perspective view showing that the distal end of each secondary wire is separated into halves and directed in different directions in the primary wire.
Figure 19:
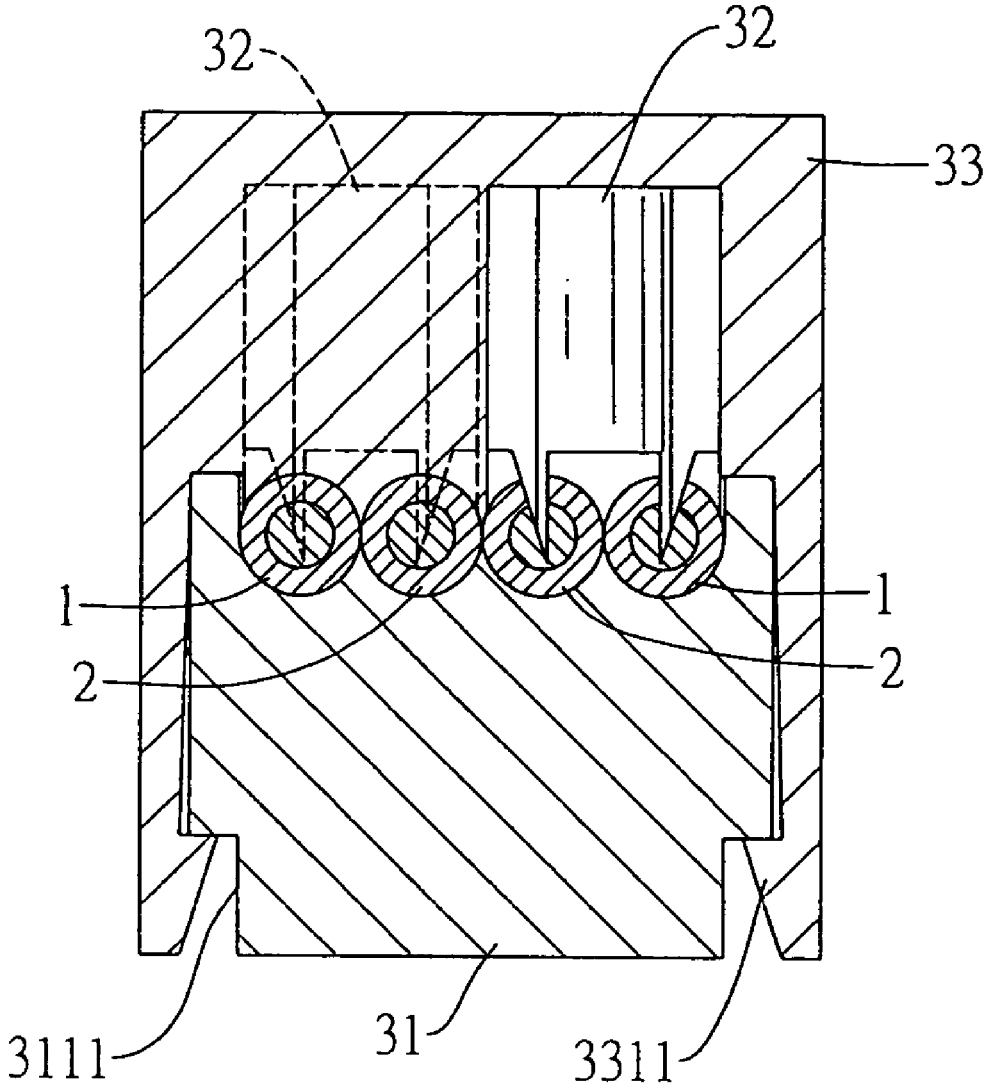
FIG. 19 is a cross sectional view showing the internal structure of the embodiment in FIG. 18.
Figure 20:
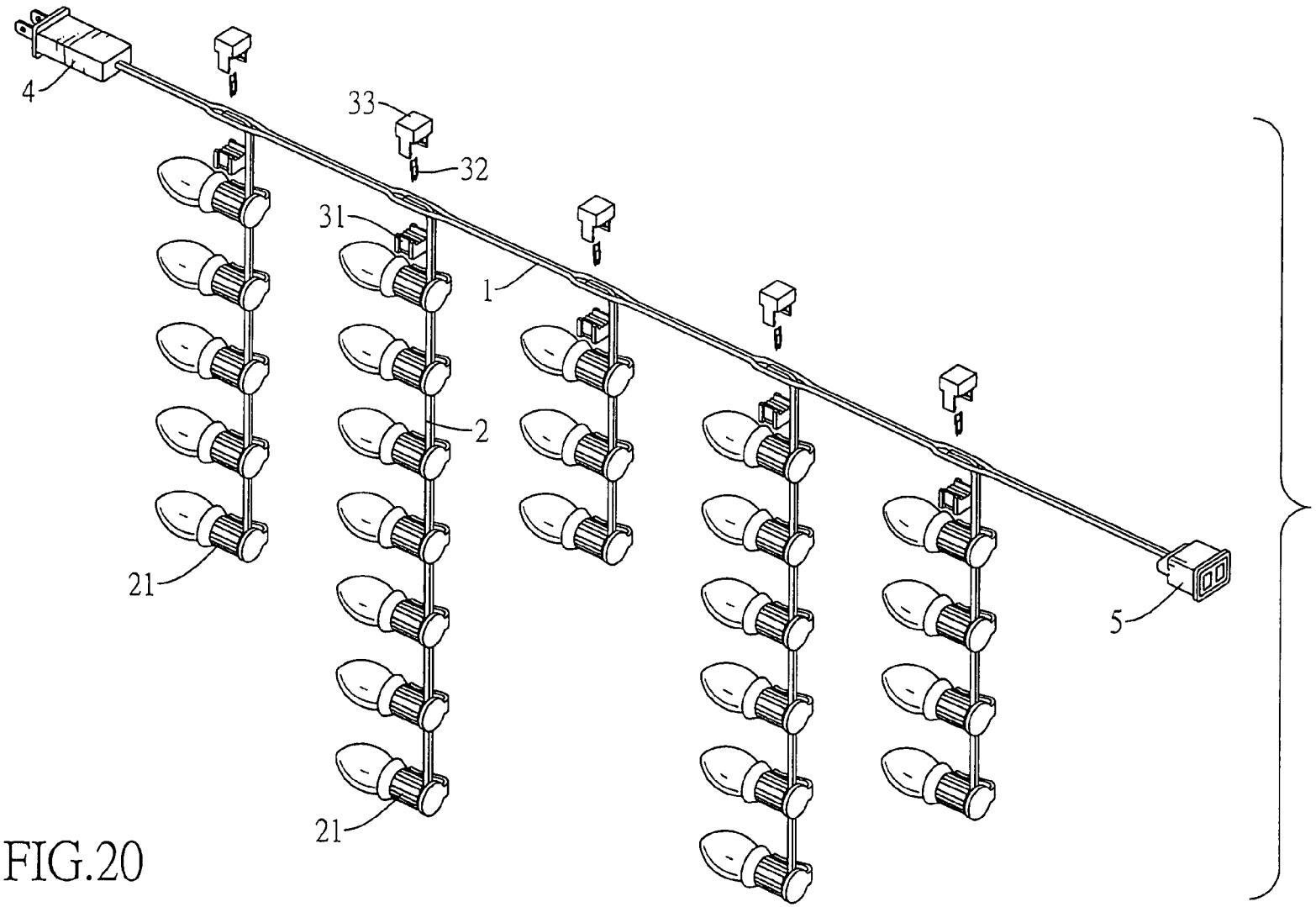
FIG. 20 is a perspective view showing the arrangement of the third embodiment of the present invention.

With reference to FIGS. 16 and 17, it is noted that when the free end of the secondary electrical wire (2) is split into halves and is sandwiched between the primary electrical wire (1), the base (31) is further provided with a stop (314) formed on a side face of the base (31) to abut against the free end of the secondary electrical wire (2). When the two halves of the free end of the secondary electrical wire (2) are directed in a direction opposite to each other and received between the primary electrical wire (1), the base (31) is now provided with two stops (314) respectively formed on two opposite sides of the base (31) to abut against two free ends of the halves of the free end of the secondary electrical wire (2). No matter the two free ends of the halves of the free end of the secondary electrical wire (2) are directed in the same direction or in different directions, after the two contacts (32) are provided to pierce through sheaths of both the primary electrical wire (1) and the secondary electrical wire (2), an electrical connection the primary electrical wire (1) and the secondary electrical wire (2) is accomplished, as shown in FIG. 19. Thus the operator is able to use the third embodiment of the present invention to arrange the light string of the present invention in the form as shown in FIG. 20.

Figure 21:
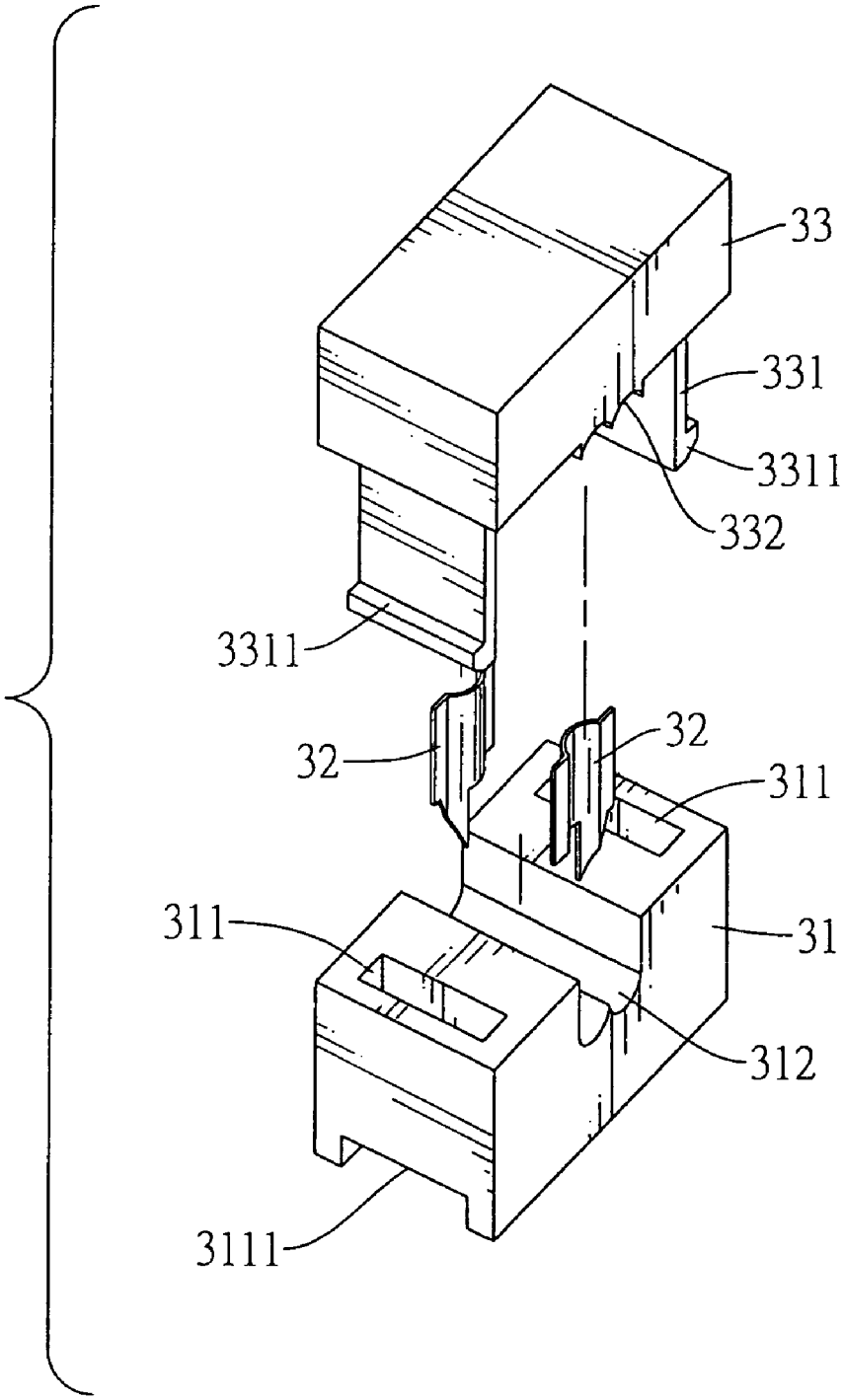
FIG. 21 is an exploded perspective view showing that the connection assembly of the present invention.
Figure 22:
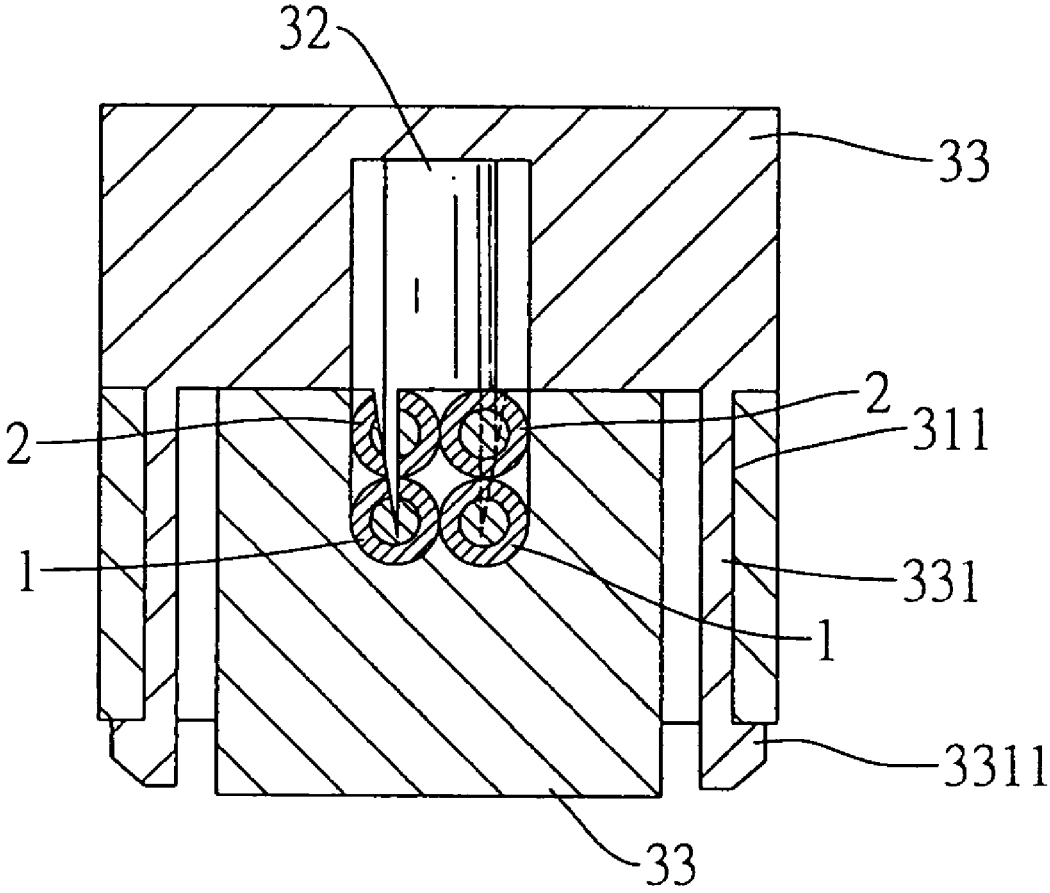
FIG. 22 is a cross sectional view of the fourth embodiment of the present invention.
Figure 23:
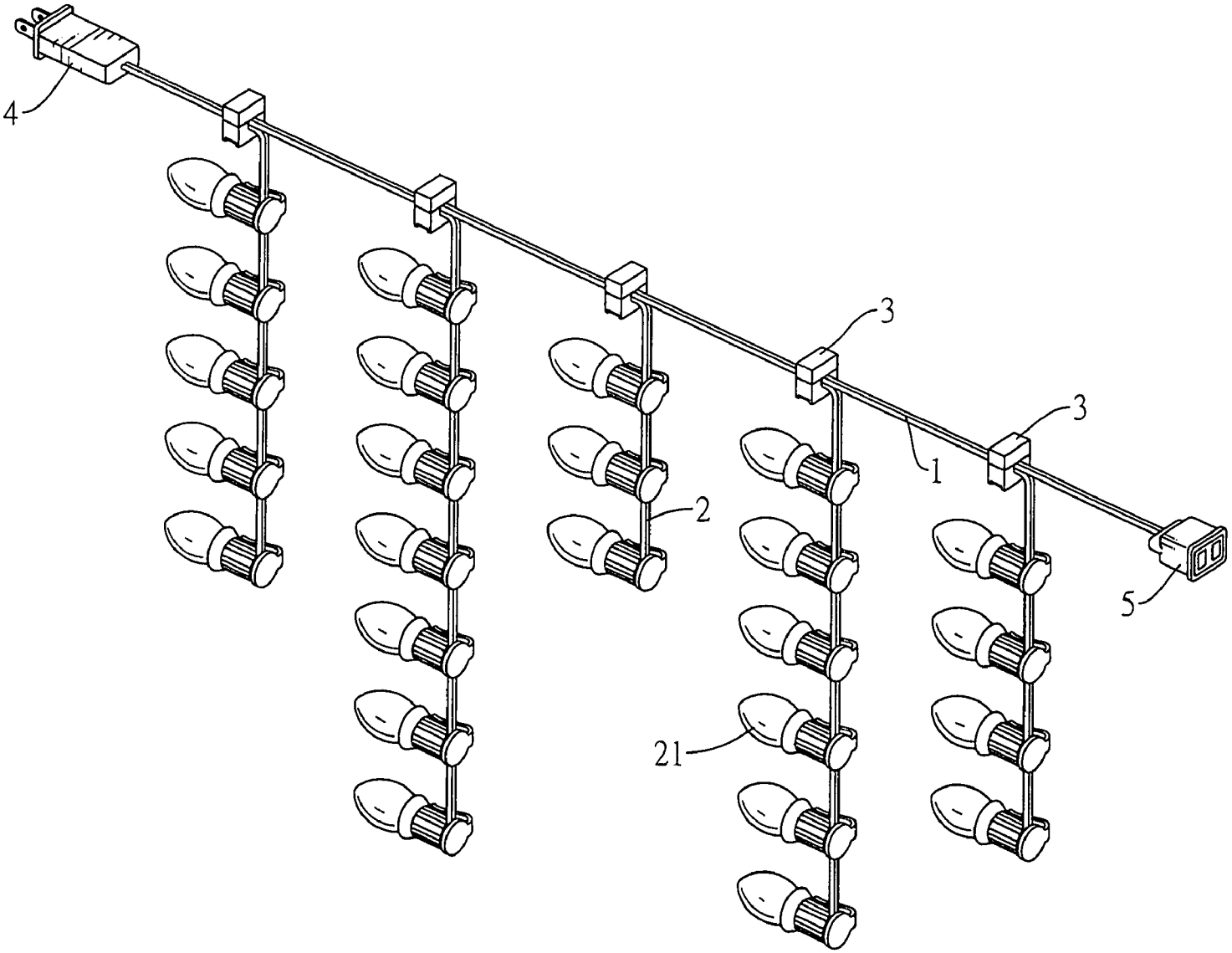
FIG. 23 is a perspective view showing the arrangement of the fourth embodiment of the present invention.

With reference to FIGS. 21 to 23, it is noted that the base (31) still has the through hole (311) defined in opposite sides of the base (31) and the cutouts (3111) respectively defined to communicate with a corresponding one of the through holes (311). Particularly, the second grooves (312) in the third embodiment are now superposed with the first grooves (312) such that the secondary electrical wire (2) is on top of the primary electrical wire (1) after the primary electrical wire (1) is first received in the first grooves (312). Thus the operator is able to use the light string in this embodiment to display a configuration as shown in FIG. 23.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light string comprising:

a primary electrical wire;

secondary electrical wires, each electrically connected to the primary electrical wire and having multiple light bulbs thereon; and multiple connection assemblies securely mounted on the primary electrical wire and each connection assembly having a base to securely receive therein the primary electrical wire and a corresponding one of the secondary electrical wires, a cap mounted on top of the base to sandwich the primary electrical wire and the corresponding one of the secondary electrical wire with the base and two contacts sandwiched between the base and the cap to electrically connect the primary electrical wire to the corresponding one of the secondary electrical wires wherein the base has a first connection member and the cap has a second connection member corresponding to the first connection member so that combination of the first connection member and the second connection member is able to securely mount the cap on top of the base so as to securely position the primary electrical wire and the corresponding secondary electrical wire between the cap and the base, and the first connection member including through holes evenly defined in peripheral edges of the base and cutouts, each evenly defined in a bottom face of the base to communicate with a corresponding one of the through holes, and the second connection member includes positioning legs extending downward from a bottom face of the cap and inserting into the through holes of the base and barbs, each formed on a free end of a corresponding one of the positioning legs to clamp a peripheral face of a corresponding one of the cutouts so as to securely position the primary electrical wire and the corresponding secondary electrical wire between the cap and the base.

2. The light string as claimed in claim 1 further comprising multiple first grooves defined in a top face of the base corresponding to and receiving therein the primary electrical wire and second grooves defined in the top face of the base corresponding to and receiving therein a corresponding one of the secondary electrical wires.

3. The light string as claimed in claim 1 further comprising multiple first grooves defined in a top face of the base corresponding to and receiving therein the primary electrical wire and second grooves defined in the top face of the base corresponding to and receiving therein a corresponding one of the secondary electrical wires.

4. The light string as claimed in claim 3, wherein the first grooves and the second grooves are crossed to each other.

5. The light string as claimed in claim 3, wherein the first grooves and the second grooves are parallel to one another.

6. The light string as claimed in claim 5, wherein trenches are respectively defined in the first grooves and the second grooves to receive therein the contacts and the cap is provided with pressing grooves to correspond to the mutually parallel first grooves and the second grooves so as to position the primary electrical wire and the corresponding one of the secondary electrical wires.

7. The light string as claimed in claim 6, wherein a free end of the corresponding secondary electrical wire is split into halves which are directed in a direction and received between the primary electrical wire.

8. The light string as claimed in claim 7, wherein each of the light bulbs is provided with a clamp which is mounted on a side of a bulb body of the light bulb to securely position an adjacent secondary electrical wire.

9. The light string as claimed in claim 5, wherein receiving slots are defined in a bottom face of the cap to correspond to the first grooves and the second grooves so as to receive therein the contacts and the contacts pierce through the primary electrical wire and the corresponding of the secondary electrical wire and the cap is provided with pressing grooves to correspond to the mutually parallel first grooves and the second grooves so as to position the primary electrical wire and the corresponding one of the secondary electrical wires.

10. The light string as claimed in claim 9, wherein a free end of the corresponding secondary electrical wire is split into halves which are directed in a direction and arranged in opposite sides of the primary electrical wire.

11. The light string as claimed in claim 9, wherein the base is provided with a stop formed on a side of the base to abut against the free end of the corresponding one of the secondary electrical wires.

12. The light string as claimed in claim 9, wherein a free end of the corresponding secondary electrical wire is split into halves which are directed in opposite directions and received between the primary electrical wire, the base is provided with two stops formed on opposite sides of the base to abut against the free end of the corresponding secondary electrical wire.

13. The light string as claimed in claim 9, wherein a free end of the corresponding secondary electrical wire is split into halves which are directed in a direction and received between the primary electrical wire.

14. The light string as claimed in claim 13, wherein each of the light bulbs is provided with a clamp which is mounted on a side of a bulb body of the light bulb to securely position an adjacent secondary electrical wire.

15. The light string as claimed in claim 13, wherein the base is provided with a stop formed on a side of the base to abut against the free end of the corresponding one of the secondary electrical wires.

16. The light string as claimed in claim 1 further comprising multiple first grooves defined in a top face of the base corresponding to and receiving therein the primary electrical wire and second grooves defined in the top face of the base corresponding to and receiving therein a corresponding one of the secondary electrical wires.

17. The light string as claimed in claim 16, wherein the first grooves and the second grooves are crossed to each other.

18. The light string as claimed in claim 16, wherein the first grooves and the second grooves are parallel to one another.

19. The light string as claimed in claim 18, wherein trenches are respectively defined in the first grooves and the second grooves to receive therein the contacts and the cap is provided with pressing grooves to correspond to the mutually parallel first grooves and the second grooves so as to position the primary electrical wire and the corresponding one of the secondary electrical wires.

20. The light string as claimed in claim 19, wherein a free end of the corresponding secondary electrical wire is split into halves which are directed in a direction and received between the primary electrical wire.

21. The light string as claimed in claim 20, wherein a free end of the corresponding secondary electrical wire is split into halves which are directed in a direction and arranged in opposite sides of the primary electrical wire.

22. The light string as claimed in claim 18, wherein receiving slots are defined in a bottom face of the cap to correspond to the first grooves and the second grooves so as to receive therein the contacts and the contacts pierce through the primary electrical wire and the corresponding of the secondary electrical wire and the cap is provided with pressing grooves to correspond to the mutually parallel first grooves and the second grooves so as to position the primary electrical wire and the corresponding one of the secondary electrical wires.

23. The light string as claimed in claim 22, wherein a free end of the corresponding secondary electrical wire is split into halves which are directed in opposite directions and received between the primary electrical wire, the base is provided with two stops formed on opposite sides of the base to abut against the free end of the corresponding secondary electrical wire.

24. The light string as claimed in claim 22, wherein a free end of the corresponding secondary electrical wire is split into halves which are directed in a direction and received between the primary electrical wire.

25. The light string as claimed in claim 24, wherein the base is provided with a stop formed on a side of the base to abut against the free end of the corresponding one of the secondary electrical wires.

26. A light string comprising:

a primary electrical wire;

secondary electrical wires each electrically connected to the primary electrical wire and having multiple light bulbs thereon; and multiple connection assemblies securely mounted on the primary electrical wire and each connection assembly having a base to securely receive therein the primary electrical wire and a corresponding one of the secondary electrical wires, a cap mounted on top of the base to sandwich the primary electrical wire and the corresponding one of the secondary electrical wire with the base and two contacts sandwiched between the base and the cap to electrically connect the primary electrical wire to the corresponding one of the secondary electrical wires, wherein the base has a first connection member and the cap has a second connection member corresponding to the first connection member, the first connection member includes through holes evenly defined in peripheral edges of the base and cutouts each evenly defined in a bottom face of the base to communicate with a corresponding one of the through holes and the second connection member includes positioning legs extending downward from a bottom face of the cap and inserting into the through holes of the base and barbs each formed on a free end of a corresponding one of the positioning legs to clamp a peripheral face of a corresponding one of the cutouts so as to securely position the primary electrical wire and the corresponding secondary electrical wire between the cap and the base, wherein multiple first grooves are defined in a top face of the base corresponding to and receiving therein the primary electrical wire and second grooves are defined in the top face of the base corresponding to and receiving therein a corresponding one of the secondary electrical wires, wherein the first grooves and the second grooves are parallel to one another.

27. The light string as claimed in claim 26, wherein receiving slots are defined in a bottom face of the cap to correspond to the first grooves and the second grooves so as to receive therein the contacts and the contacts pierce through the primary electrical wire and the corresponding of the secondary electrical wire and the cap is provided with pressing grooves to correspond to the mutually parallel first grooves and the second grooves so as to position the primary electrical wire and the corresponding one of the secondary electrical wires.

28. The light string as claimed in claim 27, wherein a free end of the corresponding secondary electrical wire is split into halves which are directed in opposite directions and received between the primary electrical wire, the base is provided with two stops formed on opposite sides of the base to abut against the free end of the corresponding secondary electrical wire.

29. A light string comprising:

a primary electrical wire;

secondary electrical wires each electrically connected to the primary electrical wire and having multiple light bulbs thereon; and multiple connection assemblies securely mounted on the primary electrical wire and each connection assembly having a base to securely receive therein the primary electrical wire and a corresponding one of the secondary electrical wires, a cap mounted on top of the base to sandwich the primary electrical wire and the corresponding one of the secondary electrical wire with the base and two contacts sandwiched between the base and the cap to electrically connect the primary electrical wire to the corresponding one of the secondary electrical wires wherein the base has a first connection member and the cap has a second connection member corresponding to the first connection member, wherein the wherein the first connection member includes through holes evenly defined in peripheral edges of the base and cutouts each evenly defined in a bottom face of the base to communicate with a corresponding one of the through holes and the second connection member includes positioning legs extending downward from a bottom face of the cap and inserting into the through holes of the base and barbs each formed on a free end of a corresponding one of the positioning legs to clamp a peripheral face of a corresponding one of the cutouts so as to securely position the primary electrical wire and the corresponding secondary electrical wire between the cap and the base, wherein multiple first grooves are defined in a top face of the base corresponding to and receiving therein the primary electrical wire and second grooves are defined in the top face of the base corresponding to and receiving therein a corresponding one of the secondary electrical wires, wherein the first grooves and the second grooves are parallel to one another.

30. The light string as claimed in claim 29, wherein trenches are respectively defined in the first grooves and the second grooves to receive therein the contacts and the cap is provided with pressing grooves to correspond to the mutually parallel first grooves and the second grooves so as to position the primary electrical wire and the corresponding one of the secondary electrical wires.

31. The light string as claimed in claim 30, wherein a free end of the corresponding secondary electrical wire is split into halves which are directed in opposite directions and received between the primary electrical wire, the base is provided with two stops formed on opposite sides of the base to abut against the free end of the corresponding secondary electrical wire.

* * * * *